US009596945B2

(12) United States Patent
Ghanei et al.

(10) Patent No.: US 9,596,945 B2
(45) Date of Patent: Mar. 21, 2017

(54) SUPPORT CUSHIONS AND METHODS FOR DISSIPATING HEAT AWAY FROM THE SAME

(71) Applicant: Tempur-Pedic Management, LLC, Lexington, KY (US)

(72) Inventors: Hamid Ghanei, Greensboro, NC (US); Tyler W. Kilgore, Kingsport, TN (US)

(73) Assignee: Tempur-Pedic Management, LLC, Lexington, KY (US)

( * ) Notice: Subject to any disclaimer, the term of this patent is extended or adjusted under 35 U.S.C. 154(b) by 0 days.

(21) Appl. No.: 14/253,963

(22) Filed: Apr. 16, 2014

(65) Prior Publication Data

US 2015/0296992 A1 Oct. 22, 2015

(51) Int. Cl.

| | |
|---|---|
| ***A47C 21/04*** | (2006.01) |
| ***A47C 27/15*** | (2006.01) |
| *A47C 27/14* | (2006.01) |

(52) U.S. Cl.

CPC ..... *A47C 21/044* (2013.01); *A47C 27/15* (2013.01); *A47C 27/144* (2013.01)

(58) Field of Classification Search

CPC ..... A47C 21/04; A47C 21/042; A47C 21/044; A47C 27/14; A47C 27/142; A47C 27/144; A47C 27/146; A47C 27/148; A47C 27/15

See application file for complete search history.

(56) References Cited

U.S. PATENT DOCUMENTS

| | | | | |
|---|---|---|---|---|
| 1,142,876 | A | 6/1915 | Davis et al. | |
| 2,461,432 | A * | 2/1949 | Mitchell | A47C 21/044 4/529 |
| 3,101,488 | A | 8/1963 | Peebles | |
| 3,266,064 | A | 8/1966 | Figman | |
| 3,529,310 | A | 9/1970 | Olmo | |
| 4,467,611 | A | 8/1984 | Nelson et al. | |
| 4,580,301 | A | 4/1986 | Ludman et al. | |
| 4,644,753 | A | 2/1987 | Burke | |
| 4,922,721 | A | 5/1990 | Robertson et al. | |
| 5,136,850 | A | 8/1992 | Bierschenk et al. | |

(Continued)

FOREIGN PATENT DOCUMENTS

| | | |
|---|---|---|
| EP | 1997467 | 12/2008 |
| JP | 55-34463 | 8/1953 |

(Continued)

OTHER PUBLICATIONS

PCT/US2009/068814 International Search Report.

(Continued)

*Primary Examiner* — Robert G Santos

(57) ABSTRACT

A support cushion is provided for dissipating heat away from the support cushion. The support cushion includes a body supporting portion and a base portion that is positioned below the body supporting portion. The base portion defines a channel that extends through the base portion and that is in fluid communication with the body supporting portion. A fan is further included in the support cushion and is operably connect to the channel of the base portion, such that the fan is positioned and configured to move an amount of air through the channel and dissipate heat away from the body supporting portion. Methods of dissipating heat away from a support cushion are also provided.

19 Claims, 9 Drawing Sheets

(56) References Cited

U.S. PATENT DOCUMENTS 5,171,372 A 12/1992 Recine, Sr.
5,249,826 A 10/1993 Bell
5,295,709 A 3/1994 Bell
5,315,830 A 5/1994 Doke et al.
5,367,879 A 11/1994 Doke et al.
5,367,890 A 11/1994 Doke
5,398,510 A 3/1995 Gilley et al.
5,448,788 A 9/1995 Wu
5,487,002 A 1/1996 Diller et al.
5,501,076 A 3/1996 Sharp, III et al.
5,505,046 A 4/1996 Nelson et al.
5,518,271 A 5/1996 Bell
5,522,216 A 6/1996 Park et al.
5,524,439 A 6/1996 Gallup et al.
5,576,512 A 11/1996 Doke
5,597,200 A 1/1997 Gregory et al.
5,626,021 A 5/1997 Karunasiri et al.
5,650,904 A 7/1997 Gilley et al.
5,703,464 A 12/1997 Karunasiri et al.
5,737,923 A 4/1998 Gilley et al.
5,860,280 A 1/1999 Recine, Sr. et al.
5,887,304 A 3/1999 von der Heyde
6,003,319 A 12/1999 Gilley et al.
6,052,853 A * 4/2000 Schmid ..... A47C 21/044 5/423
6,069,581 A 5/2000 Bell et al.
6,119,463 A 9/2000 Bell
6,169,245 B1 1/2001 Sharp
6,188,011 B1 2/2001 Nolas et al.
6,207,888 B1 3/2001 Nolas
6,223,539 B1 5/2001 Bell
6,232,910 B1 5/2001 Bell et al.
6,253,401 B1 7/2001 Boyd
6,336,237 B1 1/2002 Schmid
6,369,314 B1 4/2002 Nolas
6,370,718 B1 * 4/2002 Schmid ..... A47C 21/044 5/423
6,380,883 B1 4/2002 Bell et al.
6,399,871 B1 6/2002 Sharp
6,400,308 B1 6/2002 Bell et al.
6,425,527 B1 7/2002 Smole
6,492,585 B1 12/2002 Zamboni et al.
6,546,576 B1 4/2003 Lin
RE38,128 E 6/2003 Gallup et al.
6,606,866 B2 8/2003 Bell
6,660,925 B1 12/2003 Sharp
6,700,052 B2 3/2004 Bell
7,114,771 B2 10/2006 Lofy et al.
7,165,281 B2 1/2007 Larsson et al.
7,178,344 B2 2/2007 Bell
7,240,386 B1 7/2007 McKay et al.
7,467,435 B1 * 12/2008 McKay ..... A47C 27/15 5/423
7,469,432 B2 * 12/2008 Chambers ..... A47C 21/044 5/423
7,475,464 B2 1/2009 Lofy et al.
7,531,739 B1 5/2009 Moczygemba
7,587,901 B2 9/2009 Petrovski
7,591,507 B2 9/2009 Giffin et al.
7,619,158 B2 11/2009 Sharp et al.
7,640,754 B2 1/2010 Wolas
7,650,658 B1 * 1/2010 McKay ..... A47C 27/15 5/423
7,665,803 B2 2/2010 Wolas
7,708,338 B2 5/2010 Wolas
7,712,164 B2 * 5/2010 Chambers ..... A47C 21/044 5/423
7,763,792 B2 7/2010 Sharp et al.
RE41,765 E 9/2010 Gregory et al.
7,827,805 B2 11/2010 Comiskey et al.
7,871,847 B2 1/2011 Moczygemba
7,877,827 B2 2/2011 Marquette et al.
7,950,084 B1 * 5/2011 McKay ..... A47C 27/15 5/423
7,963,594 B2 6/2011 Wolas
7,966,835 B2 6/2011 Petrovski
7,975,331 B2 * 7/2011 Flocard ..... A47C 21/044 5/423
7,996,936 B2 8/2011 Marquette et al.
8,065,763 B2 11/2011 Brykalski et al.
8,104,295 B2 1/2012 Lofy
8,143,554 B2 3/2012 Lofy
8,181,290 B2 5/2012 Brykalski et al.
8,191,187 B2 6/2012 Brykalski et al.
8,222,511 B2 7/2012 Lofy
8,256,236 B2 9/2012 Lofy
8,332,975 B2 12/2012 Brykalski et al.
8,359,871 B2 1/2013 Woods et al.
8,402,579 B2 3/2013 Marquette et al.
8,418,286 B2 4/2013 Bryklaski et al.
8,434,314 B2 5/2013 Comiskey et al.
8,438,863 B2 5/2013 Lofy
RE44,272 E 6/2013 Bell
8,621,687 B2 * 1/2014 Brykalski ..... A47C 21/044 5/421
8,739,339 B1 * 6/2014 McKay ..... A47C 21/044 5/423
8,782,830 B2 * 7/2014 Brykalski ..... A47C 21/044 5/421
8,856,993 B2 * 10/2014 Richards ..... A47C 27/005 5/423
8,881,328 B2 * 11/2014 Mikkelsen ..... A47C 21/044 5/423
8,893,329 B2 * 11/2014 Petrovski ..... A47C 21/044 5/421
8,997,279 B1 * 4/2015 McKay ..... A47C 23/002 5/423
8,997,287 B2 * 4/2015 Lanning ..... A61G 7/057 5/421
9,131,780 B2 * 9/2015 Lachenbruch
2003/0019044 A1 1/2003 Larsson et al.
2004/0079407 A1 4/2004 Sharp
2004/0261830 A1 12/2004 Sharp et al.
2006/0080778 A1 * 4/2006 Chambers ..... A47C 21/044 5/652.2
2006/0107989 A1 5/2006 Bierschenk et al.
2006/0124165 A1 6/2006 Bierschenk et al.
2006/0180192 A1 8/2006 Sharp et al.
2007/0056116 A1 3/2007 Galardo
2008/0028536 A1 2/2008 Hadden-Cook
2008/0047598 A1 2/2008 Lofy
2008/0084095 A1 4/2008 Wolas
2008/0098529 A1 * 5/2008 Flocard ..... A47C 21/044 5/652.2
2008/0100101 A1 5/2008 Wolas
2008/0148481 A1 6/2008 Brykalski et al.
2008/0173022 A1 7/2008 Petrovski
2008/0245397 A1 10/2008 Moczygemba et al.
2009/0000031 A1 * 1/2009 Feher ..... A47C 7/74 5/423
2009/0064411 A1 * 3/2009 Marquette ..... A47C 21/044 5/423
2009/0090409 A1 4/2009 Moczygemba
2009/0090544 A1 4/2009 Rawot et al.
2009/0093078 A1 4/2009 Moczygemba
2009/0106907 A1 * 4/2009 Chambers ..... A47C 21/044 5/714
2009/0193814 A1 8/2009 Lofy
2009/0211619 A1 8/2009 Sharp et al.
2009/0218855 A1 9/2009 Wolas
2010/0011502 A1 1/2010 Brykalski et al.
2010/0081191 A1 4/2010 Woods
2010/0146700 A1 6/2010 Wolas
2010/0193498 A1 8/2010 Walsh
2010/0199687 A1 8/2010 Woods et al.
2011/0048033 A1 3/2011 Comiskey et al.
2011/0107514 A1 5/2011 Brykalski et al.
2011/0119826 A1 5/2011 Marquette et al.
2011/0247143 A1 * 10/2011 Richards ..... A47C 27/005 5/713
2011/0253340 A1 10/2011 Petrovski
2011/0258778 A1 10/2011 Brykalski et al.

(56) References Cited

U.S. PATENT DOCUMENTS

| | | | | |
|---|---|---|---|---|
| 2011/0271994 | A1 | 11/2011 | Gilley | |
| 2011/0289684 | A1 | 12/2011 | Parish et al. | |
| 2011/0296611 | A1 | 12/2011 | Marquette et al. | |
| 2011/0314837 | A1 | 12/2011 | Parish et al. | |
| 2012/0000207 | A1 | 1/2012 | Parish et al. | |
| 2012/0017376 | A1* | 1/2012 | Mikkelsen | A47C 21/044 5/726 |
| 2012/0080911 | A1 | 4/2012 | Brykalski et al. | |
| 2012/0114512 | A1 | 5/2012 | Lofy et al. | |
| 2012/0131748 | A1 | 5/2012 | Brykalski et al. | |
| 2012/0227182 | A1 | 9/2012 | Brykalski et al. | |
| 2012/0261399 | A1 | 10/2012 | Lofy | |
| 2012/0305043 | A1 | 12/2012 | Kossakovski et al. | |
| 2012/0319439 | A1 | 12/2012 | Lofy | |
| 2013/0032189 | A1 | 2/2013 | Moczygemba et al. | |
| 2013/0037073 | A1 | 2/2013 | LaGrandeur et al. | |
| 2013/0059190 | A1 | 3/2013 | Kossakovski et al. | |
| 2013/0067661 | A1* | 3/2013 | Schwirian | A61G 7/05 5/600 |
| 2013/0074272 | A1* | 3/2013 | Lachenbruch | A61G 7/05769 5/691 |
| 2013/0086923 | A1 | 4/2013 | Petrovski et al. | |
| 2013/0097777 | A1 | 4/2013 | Marquette et al. | |
| 2013/0146116 | A1 | 6/2013 | Jovovic et al. | |
| 2013/0186448 | A1 | 7/2013 | Ranalli et al. | |
| 2013/0205506 | A1* | 8/2013 | Lachenbruch | A47C 21/042 5/691 |
| 2013/0212808 | A1* | 8/2013 | Lachenbruch | A47C 27/05 5/691 |
| 2013/0227783 | A1* | 9/2013 | Brykalski | A47C 21/044 5/423 |
| 2014/0026320 | A1* | 1/2014 | Marquette | A47C 21/044 5/423 |
| 2014/0109314 | A1* | 4/2014 | Boersma | A47C 21/044 5/423 |
| 2014/0250604 | A1* | 9/2014 | Lanning | A61G 7/057 5/726 |
| 2014/0310874 | A1* | 10/2014 | Brykalski | A47C 21/044 5/423 |
| 2015/0282631 | A1* | 10/2015 | Creamer | A47C 21/044 5/423 |
| 2015/0296992 | A1* | 10/2015 | Ghanei | A47C 27/15 5/423 |
| 2016/0038101 | A1* | 2/2016 | Benner | A47C 21/044 5/421 |

FOREIGN PATENT DOCUMENTS

| | | |
|---|---|---|
| JP | 06-022829 | 1/1994 |
| JP | 6022829 | 2/1994 |
| JP | 07-313306 | 12/1995 |
| JP | 2003-024184 | 1/2003 |
| JP | 2006-014819 | 1/2006 |
| WO | 2005120295 | 12/2005 |

OTHER PUBLICATIONS

Amerigon Incorporated, "Amerigon Reports 2008 Third Quarter, Nine-Month Results," press release, Oct. 28, 2008, pp. 4-10, PR Newswire, Yahoo Inc.

* cited by examiner

SUPPORT CUSHIONS AND METHODS FOR DISSIPATING HEAT AWAY FROM THE SAME

TECHNICAL FIELD

The present invention relates to support cushions and methods for dissipating heat away from support cushions. In particular, the present invention relates to support cushions, such as mattresses, that make use of internal channels operably connected to fans to dissipate heat away from body supporting portions of the support cushions.

BACKGROUND

An aspect of successful and restful sleep is individual sleep comfort. Medical research suggests that sleep deprivation ("sleep debt") can have significant negative impacts on longevity, productivity, and overall mental, emotional, and physical health. Chronic sleep debt has been linked to weight gain and, more specifically, has been observed to not only affect the way the body processes and stores carbohydrates, but has also been observed to alter hormone levels that affect appetite. Moreover, sleep debt may result in irritability, impatience, inability to concentrate, and moodiness, which has led some researchers to suggest a link between sleep debt and worksite accidents, traffic incidents, and general afternoon inattentiveness. Furthermore, sleep disorders have been linked to hypertension, increased stress hormone levels, and irregular heartbeat, and additional research has recently suggested that a lack of sleep can affect immune function, resulting in increased susceptibility to illness and disease, e.g., cancer. In all, researchers have now suggested that sleep debt costs the United. States $63 billion annually in lost productivity due to these various effects. Accordingly, a support cushion that improves sleep comfort and lowers individual sleep debt would be both highly desirable and beneficial.

SUMMARY

The present invention includes support cushions and methods for dissipating heat away from support cushions. In particular, the present invention includes support cushions, such as mattresses, that make use of internal channels operably connected to fans to dissipate heat away from body supporting portions of the support cushions. Thus, the support cushions of the present invention allow a user to increase their level of comfort, including sleep comfort, by controlling the temperature of the body supporting portions of the support cushions.

In one exemplary embodiment of the present invention, a support cushion in the form of a mattress is provided that includes a body supporting portion having a first surface and a second surface opposite the first surface. The mattress also includes a base portion that is positioned adjacent to the second surface of the body supporting portion and that includes a head end and a foot end. The base portion defines a channel that extends longitudinally from an inlet, defined by the head end of the base portion, to an outlet, defined by the foot end of the base portion, and that is in fluid communication with the body supporting portion of the mattress. A fan is also included in the mattress and is operably connected to the channel, such that in operation, the fan moves an amount of air through the channel and dissipates heat away from the body supporting portion of the mattress, as described in further detail below.

The body supporting portion and the base portion of the mattress are generally comprised of a flexible foam. The flexible foam comprising the base portion is typically of a sufficient density and hardness for supporting the body supporting portion of the mattress. The flexible foam comprising the body supporting portion, on the other hand, typically has a density less than that of the base portion and is suitable for distributing pressure from a user's body, or portion thereof, across the body supporting portion. In some embodiments, the flexible foam is a visco-elastic foam that has a desired density and hardness, and allows pressure to be absorbed uniformly and distributed evenly across the body supporting portion of the mattress. In this regard, in certain embodiments, the body supporting portion can be further covered by a comfort portion or layer that is positioned atop the body supporting portion to provide a level of comfort to a body of a user or a portion thereof that is resting on the mattress. Such a comfort layer, in certain embodiments, is also comprised of a visco-elastic foam or other foam, but typically has a density less than that of the body supporting portion of the mattress so as to provide a softer surface on which to rest.

With respect to the fan included in the mattresses, the fan is at least operably connected to the outlet that is defined by the foot end of the base portion, such that, in operation, the fan draws air from both the inlet in the base portion and the body supporting portion, and then moves the air through the channels before removing the air from the channels through the outlet. By positioning the fan in the foot end of the base portion, the fan thus creates a flow of air through the mattress that, in turn, not only creates a pressure differential within mattress, but that also dissipates any heat present in the body supporting portion of the mattress away from body supporting portion and the rest of the mattress. In some embodiments, the base portion further includes walls that are positioned in the channels and that divert or otherwise direct the air entering the base portion through the inlet, such that the air flows more uniformly through the channel and dissipates heat away from the entirety of the body supporting portion. In some embodiments, one or more additional fans can also be included in an exemplary mattress assembly, including, for example, in the inlet defined by the base portion, to move an increased amount of air through the channel and dissipate an increased amount of heat away from the body supporting portion. Additionally, in further embodiments, one or more filters can be positioned in the inlets, the outlets, or both to ensure that fresh air is entering and exiting the base portion.

To further enhance the dissipation of heat away from the body supporting portion, in some embodiments, the body supporting portion itself can be further configured to increase the movement of air through the mattress. For example, in certain embodiments, the body supporting portion of an exemplary mattress is comprised of a reticulated visco-elastic foam that allows air to more readily move through the body supporting portion and that also allows any heat present in the body supporting portion to more readily dissipate through the body supporting portion and then away from the mattress by virtue of the movement of air through the channel and out of the outlet. In other embodiments, as an alternative or in addition to the use of reticulated visco-elastic foam in the body supporting portion, the body supporting portion can further define a plurality of columnar voids that are each in fluid communication with the channels of the base portion and that also allow for an increased amount of air to travel through and dissipate heat away from the body supporting portion.

Regardless of the particular configuration of the body supporting portion of the mattresses of the present invention, each mattress further includes a power supply for supplying electrical current to the fan, and a controller for controlling the electrical current that is supplied to the fan. By including a controller in the mattresses, the amount of electrical current supplied to the fan can be controlled to allow for a desired amount of air to move through the mattress and, consequently, a desired amount of heat to be dissipated away from the body supporting portion of the mattress. For example, in certain embodiments, the controller is configured to automatically control the electrical current supplied to the fan, such that the electrical current can be supplied to the fan when the first surface of the body supporting portion reaches a particular temperature. As another example, the controller, in some embodiments, is configured to allow the electrical current to be supplied to the fan for a predetermined time period, such as for an 8-hour sleeping period or for a length of time that corresponds to the time a user usually spends in a specific stage of the sleep cycle (e.g., REM sleep).

To provide an additional level of control over the fan included in the mattresses of the present invention, in certain embodiments, the mattresses further include one or more features that are operably connected to the body supporting portion and provide input to the controller. Such features include, in some embodiments, pressure sensors that provide pressure feedback to the controller and allow the controller to automatically begin moving an amount of air through the mattress and dissipating heat away from the body supporting portion when a user lies on the mattress or otherwise places an amount of pressure on the mattresses. In other embodiments, temperature sensors are included in an exemplary mattress and provide temperature feedback to the controller to allow the controller to selectively begin moving an amount of air through the mattress and dissipating heat away from the body supporting portion in response to received temperature feedback and to maintain a desired temperature. Such desired temperature or pressure feedback settings are, in certain embodiments, directly inputted or adjusted at the controller itself or, in other embodiments, can be transmitted to the controller from a remote control that is also operably connected to the controller.

With further respect to the support cushions of the present invention, an exemplary support cushion can also be used as part of a method of dissipating heat away from a support cushion. In some implementations, a method of dissipating heat away from a support cushion includes first providing a support cushion having: a body supporting portion; a base portion that is positioned adjacent to the body supporting portion and that defines a channel extending through the base portion, with the channel being in fluid communication with the body supporting portion; and a fan that is operably connected to the channel. Power, in the form of electrical current, is then supplied to the fan, such that the fan moves an amount of air through the channel and then dissipates heat away from the body supporting portion to thereby increase the comfort of a user resting on the mattress.

Further features and advantages of the present invention will become evident to those of ordinary skill in the art after a study of the description, figures, and non-limiting examples in this document.

DESCRIPTION OF EXEMPLARY EMBODIMENTS

Figure 1:
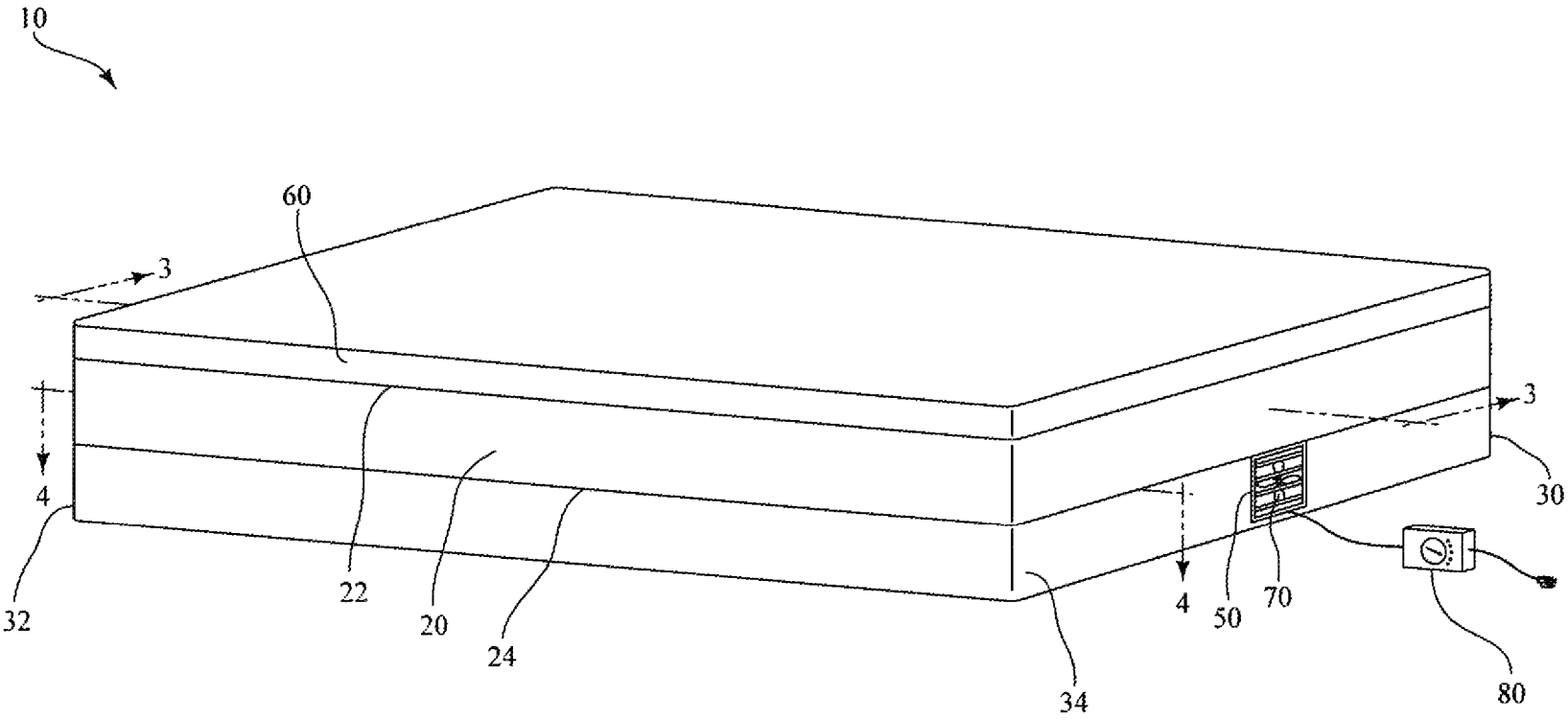
FIG. 1 is a perspective view of an exemplary support cushion, in the form of a mattress, made in accordance with the present invention.

The present invention includes support cushions and methods for dissipating heat away from support cushions. In particular, the present invention includes support cushions, such as mattresses, that make use of internal channels operably connected to fans to dissipate heat away from body supporting portions of the support cushions. Thus, the support cushions of the present invention allow a user to increase their level of comfort, including sleep comfort, by controlling the temperature of the body supporting portions of the support cushions.

Referring first to FIGS. 1-4, in one exemplary embodiment of the present invention, a support cushion in the form of a mattress 10 is provided that includes a body supporting portion 20 having a first surface 22, which is generally an upper surface of the body supporting portion 20, and a second surface 24, which is opposite the first surface 22, and is generally the lower surface of the body supporting portion 20. The mattress 10 further includes a base portion 30, which is adjacent to the second surface 24 of the body supporting portion 20 and includes a first exterior surface 32, which is generally the head end of the base portion 30, and a second exterior surface 34, which is generally the foot end of the base portion 30. The base portion 30 further defines a channel 36, which extends from an inlet 40 defined by the first exterior surface 32 of the base portion 30 to an outlet 50 defined by the second exterior surface 34 of the base portion 30, and which is in fluid communication with the body supporting portion 20 of the mattress 10. A fan 70 is also included in the mattress 10 and is operably connected to the channel 36 of the base portion 30, such that, in operation, the fan 70 moves an amount of air through the channel 36 and dissipates heat away from the body supporting portion 20 of the mattress 10, as described in further detail below.

The body supporting portion 20 and the base portion 30 of the mattress 10 are generally comprised of a flexible foam. The flexible foam comprising the base portion 30 is typically of a sufficient density and hardness for supporting the body supporting portion 20 of the mattress 10. The flexible foam comprising the body supporting portion, on the other hand, typically has a density less than the base portion 30 and is suitable for distributing pressure from a user's body or portion thereof across the body supporting portion 20. Such flexible foams include, but are not limited to, latex foam, reticulated or non-reticulated visco-elastic foam (sometimes referred to as memory foam or low-resilience foam), reticulated or non-reticulated non-visco-elastic foam, polyurethane high-resilience foam, expanded polymer foams (e.g., expanded ethylene vinyl acetate, polypropylene, polystyrene, or polyethylene), and the like. In the embodiment shown in FIGS. 1-4, both the base portion 30 and the body supporting portion 20 are comprised of a non-reticulated visco-elastic foam that has a low resilience as well as a sufficient density and hardness, which allows pressure to be absorbed uniformly and distributed evenly the mattress 10. Generally, such visco-elastic foams have a hardness of at least about 10 N to no greater than about 80 N, as measured by exerting pressure from a plate against a sample of the material to a compression of at least 40% of an original thickness of the material at approximately room temperature (i.e., 21° C. to 23° C.), where the 40% compression is held for a set period of time as established by the International Organization of Standardization (ISO) 2439 hardness measuring standard. In some embodiments, the visco-elastic foams used in the body supporting portion 20 and the base portion 30 have a hardness of about 10 N, about 20 N, about 30 N, about 40 N, about 50 N, about 60 N, about 70 N, or about 80 N to provide a desired degree of comfort and body-conforming qualities.

The visco-elastic foam described herein for use in the mattress 10 can also have a density that assists in providing a desired degree of comfort and body-conforming qualities, as well as an increased degree of material durability. In some embodiments, the visco-elastic foams used in the body supporting portion 20 and base portion 30 have a density of no less than about 30 kg/m$^3$ to no greater than about 150 kg/m$^3$. In some embodiments, the density of the visco-elastic foams used in the body supporting portion 20 and base portion 30 is about 30 kg/m$^3$, about 40 kg/m$^3$, about 50 kg/m$^3$, about 60 kg/m$^3$, about 70 kg/m$^3$, about 80 kg/m$^3$, about 90 kg/m$^3$, about 100 kg/m$^3$, about 110 kg/m$^3$, about 120 kg/m$^3$, about 130 kg/m$^3$, about 140 kg/m$^3$, or about 150 kg/m$^3$. Of course, the selection of a visco-elastic foam having a particular density will affect other characteristics of the foam, including its hardness, the manner in which the foam responds to pressure, and the overall feel of the foam, but it is appreciated that a visco-elastic foam having a desired density and hardness can readily be selected for a particular application or mattress as desired. Additionally, it is appreciated that the body supporting portion 20 or the base portion 30 need not be comprised of flexible foam at all, but can also take the form of more traditional mattresses, including spring-based mattresses, without departing from the spirit and scope of the subject matter described herein.

Referring still to FIGS. 1-4, the body supporting portion 20 of the mattress 10 is further covered by a comfort layer 60 that is positioned atop the body supporting portion 20 adjacent to the first surface 22 of the body supporting portion 20. The comfort layer 60 provides a level of comfort to a body of a user or a portion thereof that is resting on the mattress 10. The comfort layer 60 can also be comprised of a visco-elastic foam. However, the comfort layer 60 typically has a density, hardness, or both that is less than that of the body supporting portion 20 of the mattress 10, such that the comfort layer 60 provides a softer surface on which to rest the body of a user or a portion thereof. For example, in certain embodiments, the mattress 10 includes a body supporting portion 20 that is comprised of visco-elastic foam with a density of about 80 kg/m$^3$ and a hardness of about 13 N, while the comfort layer 60 is comprised of a visco-elastic foam with a density of about 35 kg/m$^3$ and a hardness of about 10 N.

With further respect to the body supporting portions and base portions included in an exemplary mattress assembly, it is additionally contemplated that an exemplary body supporting portion or base portion can be further comprised of one or more different or additional layers having various densities and hardnesses. For instance, it is contemplated that a layer of high-resilience polyurethane foam can be secured to the second surface of a layer of low-resilience visco-elastic foam used in a body supporting portion of the mattress. Such multi-layered portions are described, for example, in U.S. Pat. Nos. 7,469,437; 7,507,468; 8,025,964; and 8,034,445, as well as in U.S. Patent Application Publication No 2011/0252562, each of which is incorporated herein by this reference.

Regardless of the particular configuration of the body supporting portion 20, the base portion 30, and the comfort layer 60, the body supporting portion 20, the base portion 30, and the comfort layer 60 are generally secured to one another to prevent the body supporting portion 20, the base portion 30, and the comfort layer 60 from moving relative to one another during use. Various means of securing one layer of material to another can be used in this regard, including tape, hook and loop fasteners, conventional fasteners, stitches, and the like. In one particular embodiment, the body supporting portion 20, the base portion 30 and the comfort layer 60 are bonded together by an adhesive or cohesive bonding material to create a substantially continuous assembly where the body supporting portion 20, the base portion 30 and the comfort layer 60 are fully adhered to one another. Such adhesive bonding materials include, for example, environmentally-friendly, water based adhesives, like SABA AQUABOND RSD, a two-component water-based adhesive product produced by SABA DINXPERLO BV, B-7090 AA, Dinxperlo, Belgium.

Turning now to the fan 70 included in the mattress 10 shown in FIGS. 1-4, the fan 70 is operably connected to the outlet 50 that is defined by the second exterior surface 34 (i.e., the foot end) of the base portion 30 and that is in fluid communication with not only the channel 36 and the inlet 40, but also the body supporting portion 20. As such in operation, the fan 70 draws air from both the inlet 40 and from the body supporting portion 20, and then moves the air through the channel 36 before removing the air from the channel 36 through the outlet 50. By positioning the fan 70 in the outlet 50, the fan 70 thus creates a flow of air through the mattress 10 that, in turn, not only creates a pressure differential within the mattress 10, but that also dissipates any heat present in the body supporting portion 20 of the mattress 10 away from the body supporting portion 20 and then away from the remainder of the mattress 10. In this regard, to help ensure that heat is being dissipated away from the entirety of the body supporting portion 20, the base portion 30 of the mattress 10 also includes a number of walls 38 that are positioned in the channel 36, such that air flows more uniformly through the channel 36 and heat is more uniformly dissipated away from the body supporting portion 20. Further, to ensure that fresh air is entering the base portion 30 and more specifically, the channel 36, the mattress 10 also includes a filter 76 that covers the inlet 40, such that only filtered air is allowed to pass into the channel 36 through the inlet 40 and the channel 36 is kept free of particulates such as smoke, dust, dirt, pollen, mold, bacteria, hair, or insects that may otherwise collect in the interior of the mattress 10 and limit air flow through the channel 36. Of course, it is contemplated that various types of filters including, but not limited to, charcoal filters for removing chemicals and/or unpleasant odors can be readily incorporated into an exemplary mattress of the present invention without departing from the spirit and scope of the subject matter described herein.

Figure 2:
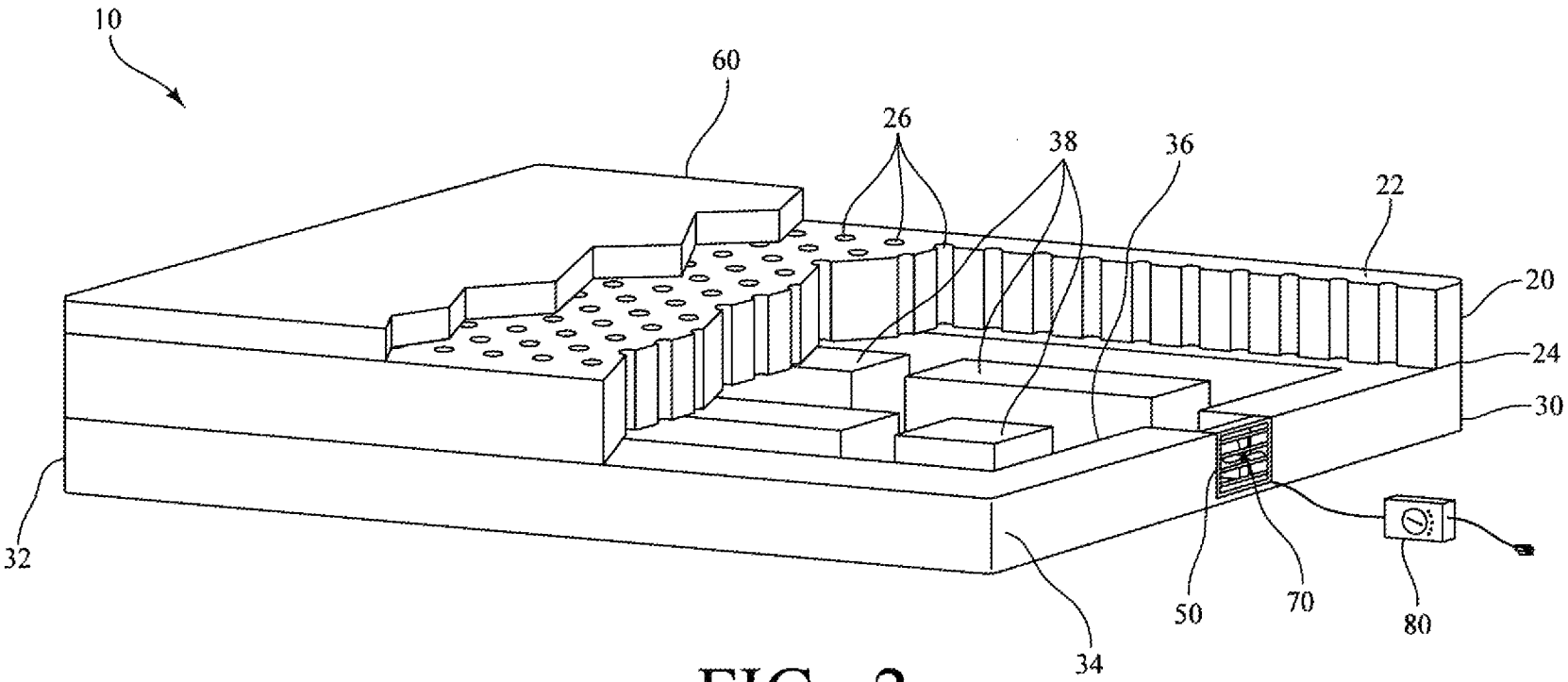
FIG. 2 is a perspective view of the exemplary mattress of FIG. 1, but with a portion of the mattress removed to show a channel in the base portion of the mattress and a plurality of columnar voids in the body supporting portion of the mattress.
Figure 3:
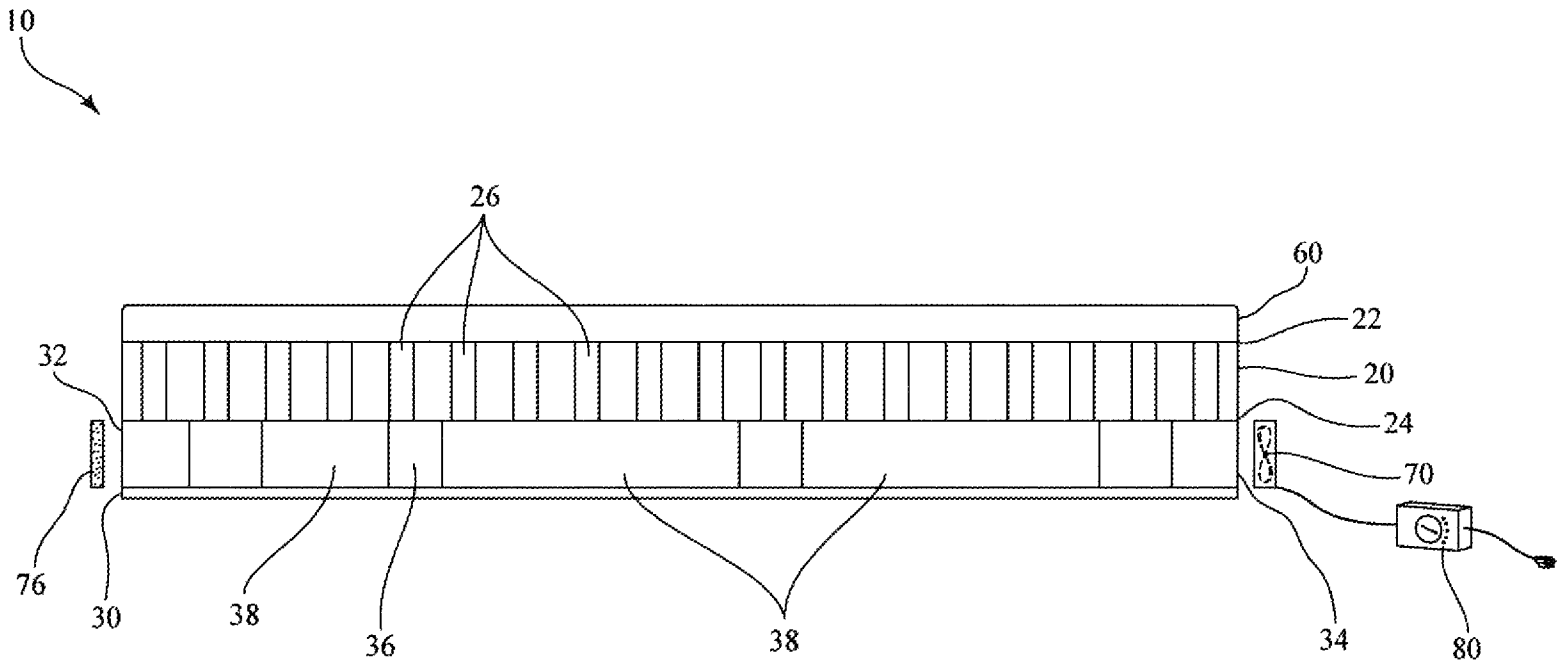
FIG. 3 is a cross-sectional view of the exemplary mattress of FIG. 1 taken along line 3-3 of FIG. 1, and with the filter and fan removed from the base portion of the mattress.
Figure 4:
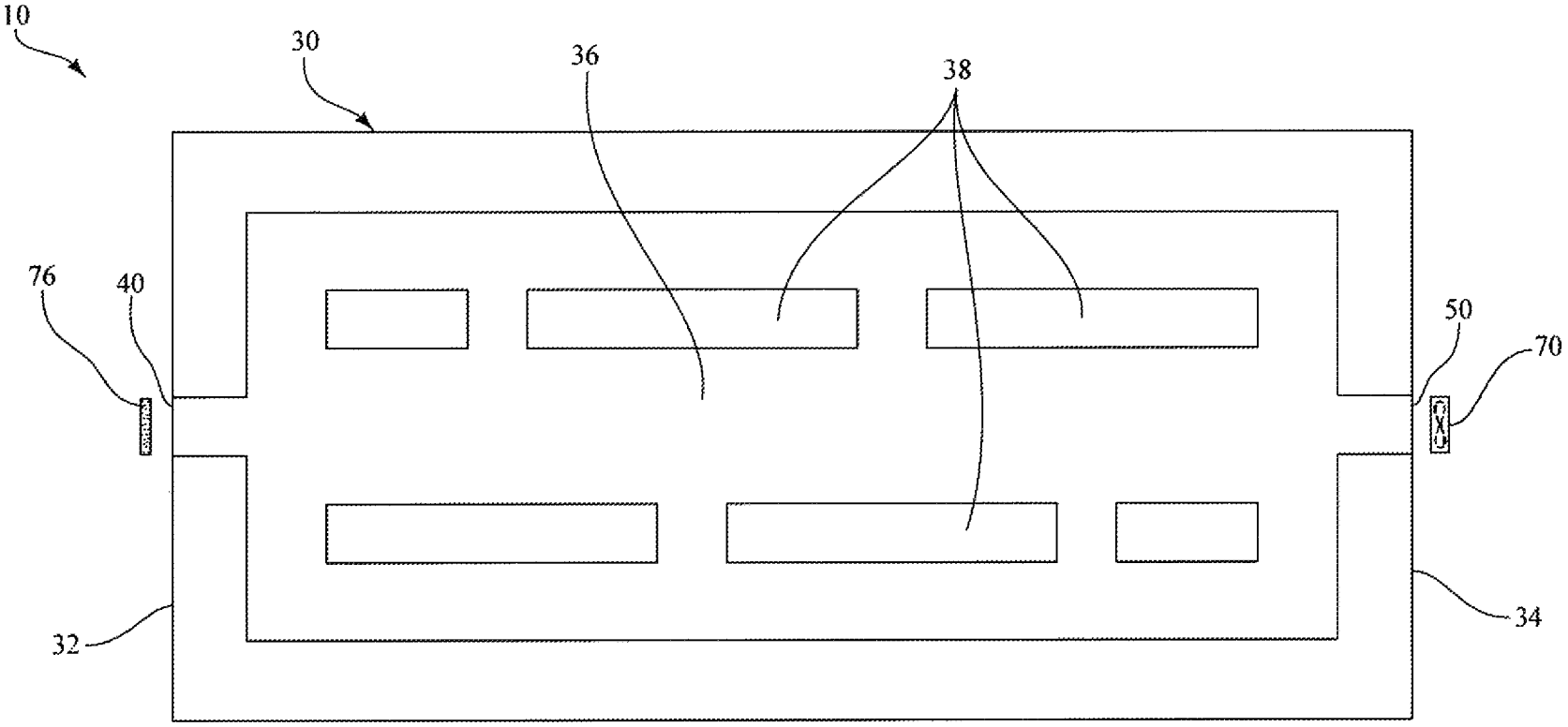
FIG. 4 is another cross-sectional view of the exemplary mattress of FIG. 1, but taken along line 4-4 of FIG. 1.

With further respect to the movement of air through the mattress 10, in the mattress 10, the body supporting portion 20 is also configured to increase the movement of air through the mattress 10 and to enhance the dissipation of heat away from the body supporting portion 20. In particular, to further enhance heat movement within, through, and away from the body supporting portion 20 of the mattress 10, the body supporting portion 20 defines a plurality of columnar voids 26 that extend from the second surface 24 of the body supporting portion 20 to the first surface 22 of the body supporting portion 20. Each of the columnar voids 26 are in fluid communication with the channel 36, such that during operation of the fan 70, the columnar voids 26 allow for air to more readily travel through the body supporting portion 20 and heat to more readily dissipate away from the body supporting portion 20. As best shown in FIG. 2, in the mattress 10, the columnar voids 26 are arranged in a regular grid-like pattern to help ensure uniform movement of air through, and a uniform dissipation of heat away from, the body supporting portion 20. However, it is also contemplated that voids having various sizes and shapes can also be included in an exemplary mattress assembly as may be desired for a particular application or user. For example, for users prone to excessive heating during sleep, it is contemplated that an exemplary mattress assembly can be provided having voids with larger diameters positioned in a central region of the body supporting portion of a mattress that would be in contact with the portion of the body of the user that is prone to excessive heating (e.g., the torso).

Irrespective of the particular configuration of the body supporting portion of an exemplary mattress, and referring still to FIGS. 1-4, the mattress 10 also includes a controller 80 for controlling the power supplied to the fan 70. By including the controller 80 in the mattress 10, the amount of electrical current supplied to the fan 70 can be controlled to allow for a desired amount of air to move through the mattress 10 and, consequently, a desired amount of heat to be dissipated away from the body supporting portion 20 of the mattress 10. For example, the controller 80 can be used to simply turn the fan 70 on or off depending on whether the user wishes to remove heat from the mattress 10, or can be used to operate the fan 70 at a particular speed depending on how quickly the user wishes to remove heat from the mattress 10. Alternatively, the controller can also be configured to automatically control the electrical current supplied to the fan 70, such that the electrical current can be supplied to the fan 70 when the first surface 22 of the body supporting portion 20 reaches a desired temperature. As another example, the controller can be configured to allow the electrical current to be supplied to the fan 70 for a predetermined time period, such as for an 8-hour sleeping period or for a length of time a user usually spends in a specific stage of the sleep cycle (e.g., REM sleep) in order to increase the sleep comfort of a user.

Figure 5:
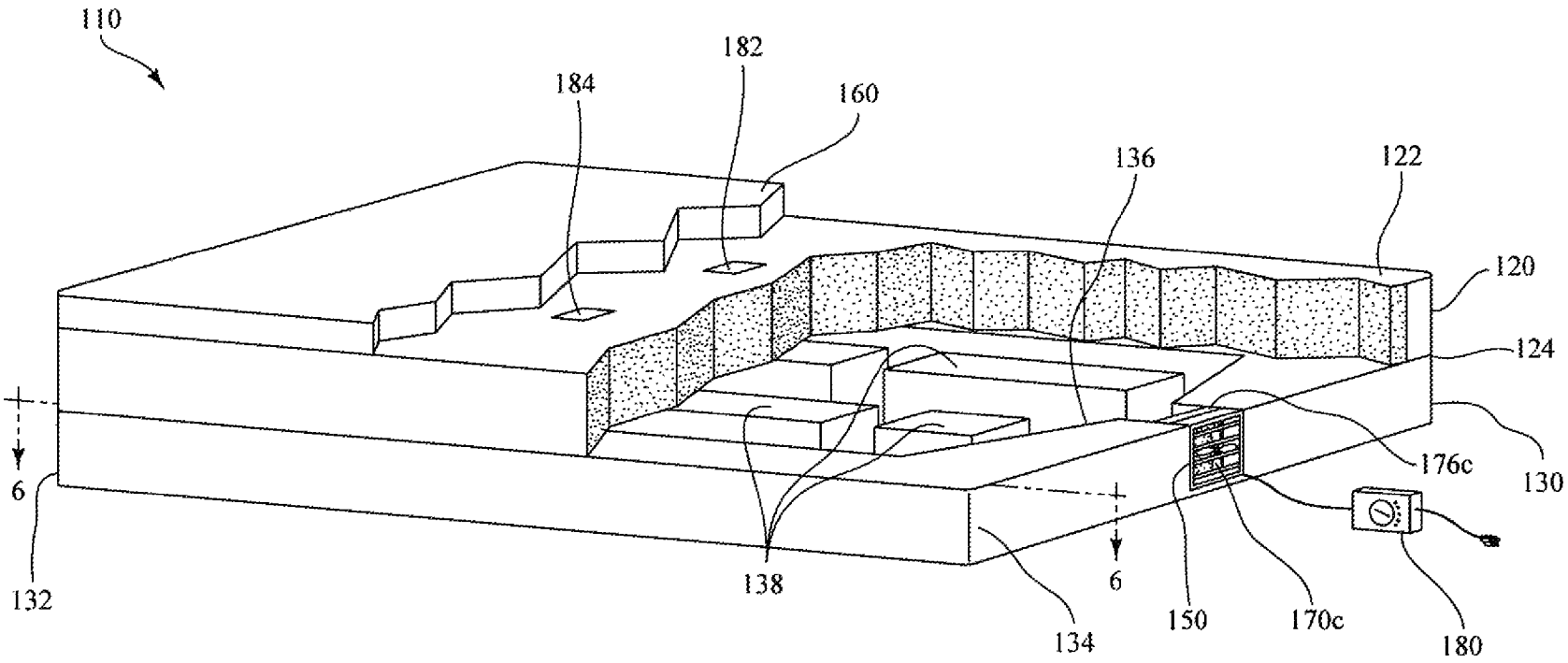
FIG. 5 is a perspective view of another exemplary support cushion, in the form of a mattress, made in accordance with the present invention, with a portion of the mattress removed to show a channel in the base portion.
Figure 6:
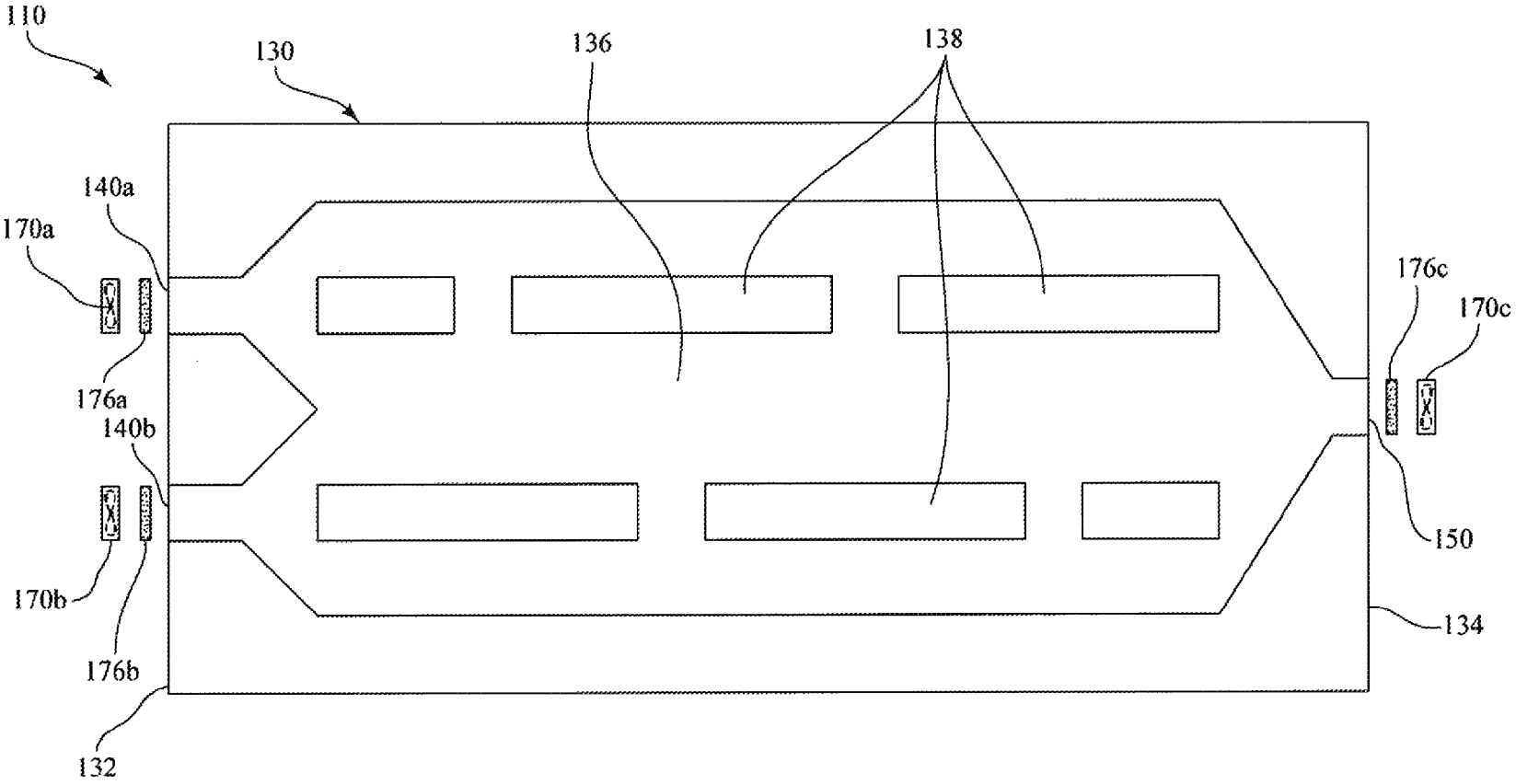
FIG. 6 is a cross-sectional view of the exemplary mattress of FIG. 5 taken along line 6-6 of FIG. 5, and with the filters and fans removed from the base portion of the mattress.

As a refinement, in another embodiment of the present invention that makes use of a controller for controlling a fan and an amount of air moving through an exemplary mattress, and referring now to FIGS. 5-6, an exemplary mattress 110 is provided that includes a comfort layer 160, a body supporting portion 120 having a first surface 122 and a second surface 124, and a base portion 130 having a first exterior surface 132 and a second exterior surface 134. The base portion 130 also defines a channel 136 with a number of walls 138 positioned in the channel 136. Unlike the mattress 10 shown in FIGS. 1-4, however, the channel 136 does not extend from a single inlet to single outlet. Rather, in the mattress 110, the channel 136 extends from two inlets 140*a*, 140*b* defined by the first exterior surface 132 of the base portion 130 to an outlet 150 defined by the second exterior surface 134 to allow for an increased amount of air to be drawn into the channel 136 and, consequently, an increased amount of heat to be dissipated away from the body supporting portion 120 of the mattress 110. In this regard, the mattress 110 also includes three fans 170*a*, 170*b*, 170*c* operably connected to a controller 180, with one of the fans 170*a*, 170*b*, 170*c* being operably connected to each of the inlets 140*a*, 140*b* and the outlet 150 to improve air flow through the channel 136. The mattress further includes three filters 176*a*, 176*b*, 176*c*, with one of the filters 176*a*, 176*b*, 176*c* operably connected to each of the two inlets 140 and to the outlet 150 to ensure that filtered air is entering and exiting from the channel 136.

As a further refinement to the mattresses of the present invention, and referring still to FIGS. 5-6, the body supporting portion 120 of mattress 110 does not make use of a plurality of columnar voids that extend from the first surface 122 to the second surface 124 of the body supporting portion 120 to enhance air movement within, through, and away from the body supporting portion 120 of the mattress 110. Instead, in the mattress 110, the body supporting portion 120 is comprised of a continuous layer of reticulated visco-elastic foam to allow for a sufficient amount of air to travel through the body supporting portion 120 and for heat to be dissipated away from the body supporting portion 120. Such reticulated foam (visco-elastic or otherwise) has a cellular foam structure in which the cells of the foam are essentially skeletal. In other words, the cells of the reticulated foam are each defined by a plurality of apertured windows surrounded by cell struts, where the cell windows of reticulated foam can be entirely absent (leaving only the cell struts) or substantially missing. In some embodiments, the foam is considered "reticulated" if at least 50% of the windows of the cells are missing (i.e., windows having apertures therethrough, or windows that are completely missing and therefore leaving only the cell struts). Such structures can be created by destruction or other removal of cell window material, by chemical or mechanical means, or by preventing the complete formation of cell windows during the manufacturing process of the foam.

Irrespective of the manufacturing process used to produce the reticulated foam, reticulated foam, by virtue of its reticulated cellular structure, has characteristics that are well suited for use in the body supporting portion 120 of the mattress 110, including the enhanced ability to permit fluid movement through the reticulated foam and, consequently, the ability to provide enhanced heat dissipation away from the body supporting portion 120 and the comfort layer 160 of the mattress 110. In this regard, by using reticulated foam in the body supporting portion 120, when the first surface 122 of the body supporting portion 120 is heated, the heat is readily dissipated throughout the reticulated foam of the body supporting portion 120 and is then transferred out of the body supporting portion 120, into the channel 136, and out of the outlet 150 by virtue of the operation of the fans 170*a*, 170*b*, 170*c* connected to the channel 136.

To provide an additional level of control over the movement of air in the mattress 110, the mattress 110 also includes several features that are operably connected to the body supporting portion 120 and provide input to the controller 180. For example, as shown best in FIG. 5, the mattress 110 includes a temperature sensor 182 that provides temperature feedback to the controller 180 to thereby allow the controller to selectively provide power to the fans 170*a*, 170*b*, 170*c* and adjust how quickly or how much heat is removed from the mattress 110 in response to the received temperature feedback and to thereby maintain a desired temperature at the first surface 122 of the body supporting portion 120. As also shown in FIG. 5, a pressure sensor 184 is also operably connected to the body supporting portion 120 and provides pressure feedback to the controller 180 in response to a user resting upon or adjacent to the first surface 122 of the body supporting portion 120 to thereby allow the controller 180 to automatically begin providing power to the fans 170*a*, 170*b*, 170*c* and begin removing heat from the mattress 110 as soon as the user lies on the mattress 110 or otherwise places an amount of pressure on the mattress 110. An additional benefit of the inclusion of the pressure sensor 184 is that the controller 180 can be configured to automatically shut off the fans 170 if a user is no longer lying on the mattress 110. Such desired temperature or pressure feedback settings can be directed inputted or adjusted at the controller 180 itself, or in certain embodiments of the present invention, can be transmitted to the controller 180 from a remote control that is also operably connected to the controller 180.

Figure 7:
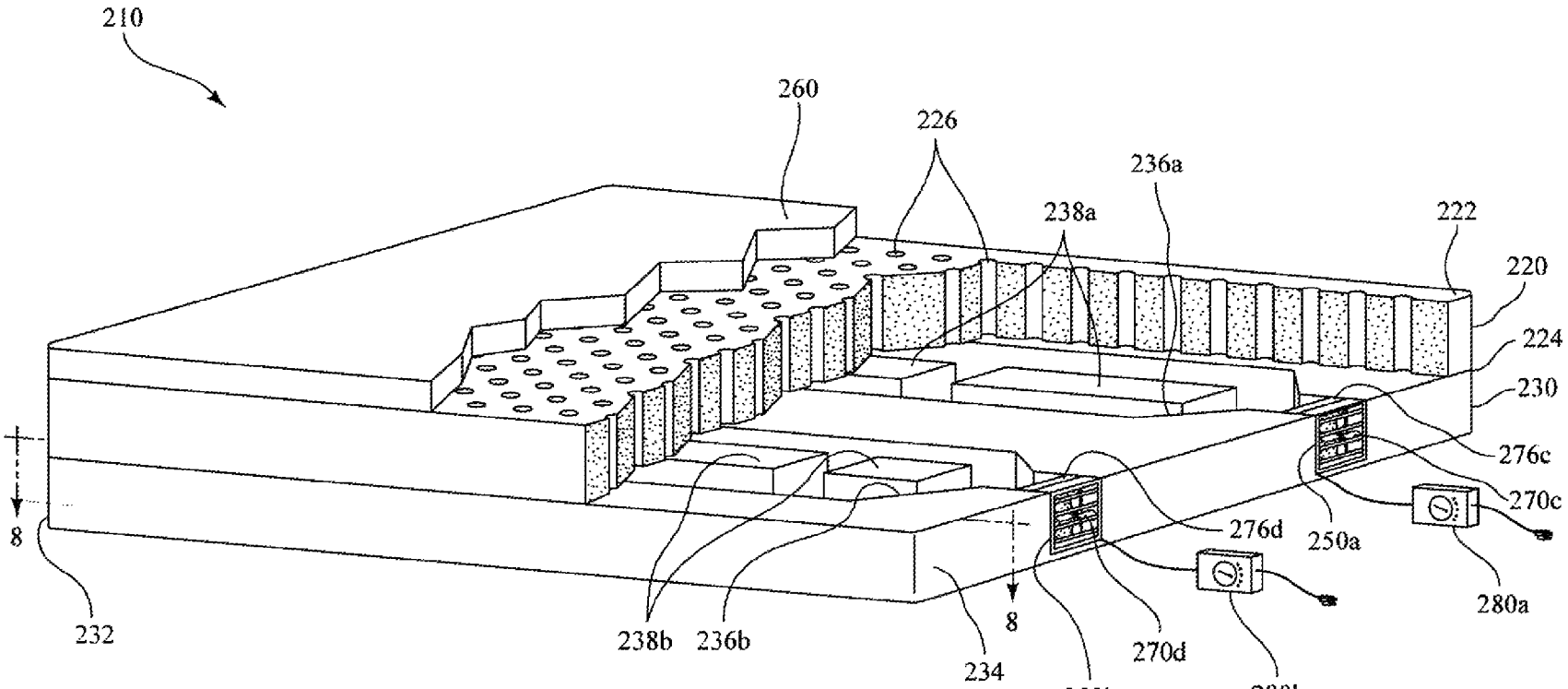
FIG. 7 is a perspective view of another exemplary support cushion, in the form of a mattress, made in accordance with the present invention, with a portion of the mattress removed to show a pair of channels in the base portion.
Figure 8:
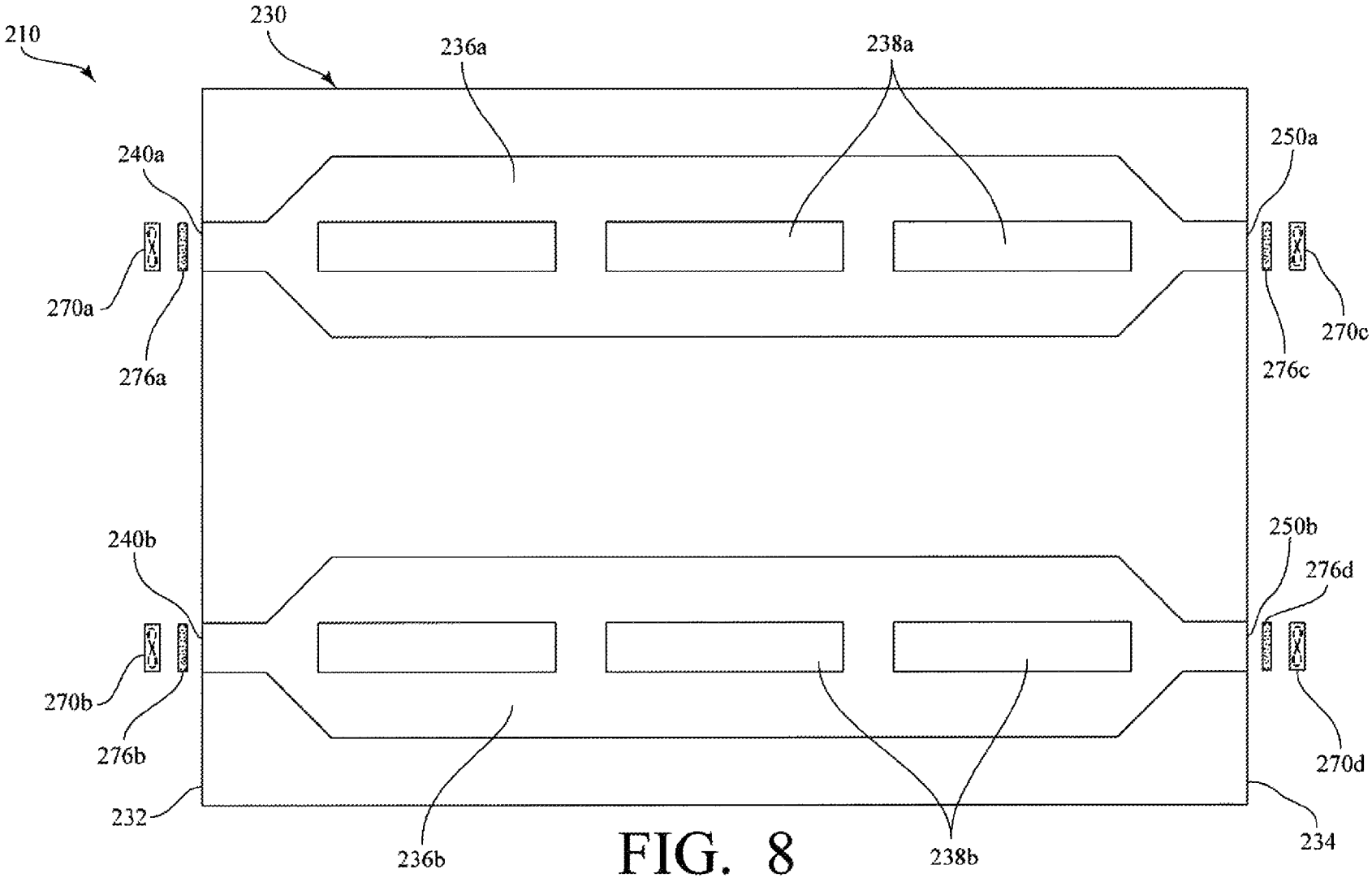
FIG. 8 is a cross-sectional view of the exemplary mattress of FIG. 7 taken along line 8-8 of FIG. 7, and with the filters and fans removed from the base portion of the mattress.

As an even further refinement to the present invention, and referring now to FIGS. 7-8, another exemplary mattress 210 is provided that includes a comfort layer 260, a body supporting portion 220 having a first surface 222 and a second surface 224, and a base portion 230 having a first exterior surface 232 and a second exterior surface 234. Unlike the mattresses 10, 110 shown in FIGS. 1-4 and 5-6, however, the body supporting portion 220 is both comprised of a reticulated visco-elastic foam and also includes a plurality of columnar voids 226 to move an amount of air through and dissipate heat away from the body supporting portion 220. Also unlike the mattresses 10, 110 shown in FIGS. 1-4 and 5-6, the mattress 210 does not make use of a single channel in a base portion, but instead includes a base portion 230 that defines a first channel 236*a* on one side of the mattress 210 and a second channel 236*b* on the opposite side of the mattress 210. The first channel 236*a* includes a number of walls 238*a* positioned in the channel 236*a*, and extends from a first inlet 240*a* defined by the first exterior surface 232 to a first outlet 250*a* defined by the second exterior surface 234. Likewise, the second channel 236*b* includes a number of walls 238*b* positioned in the second channel 236*b*, and extends from a second inlet 240*b* defined by the first exterior surface 232 to a second outlet 250*b* defined by a second exterior surface 234. A fan 270*a*, 270*b*, 270*c*, 270*d* and a filter 276*a*, 276*b*, 276*c*, 276*d* are included in each of the inlets 240*a*, 240*b* and outlets 250*a*, 250*b* of the channels 236*a*, 236*b*, with a first controller 280*a* operably connected to the fans 270*a*, 270*c* associated with the first channel 236*a* and a second controller 280*b* operably connected to the fans 270*b*, 270*d* associated with the second channel 236*b*. In this regard, in operation, the fans 270*a*, 270*c* associated with the first channel 236*a* can be operated independently from the fans 270*b*, 270*d* associated with the second channel 236*b* to thereby selectively move air through and dissipate heat away from a particular side of the mattress 210.

Figure 9:
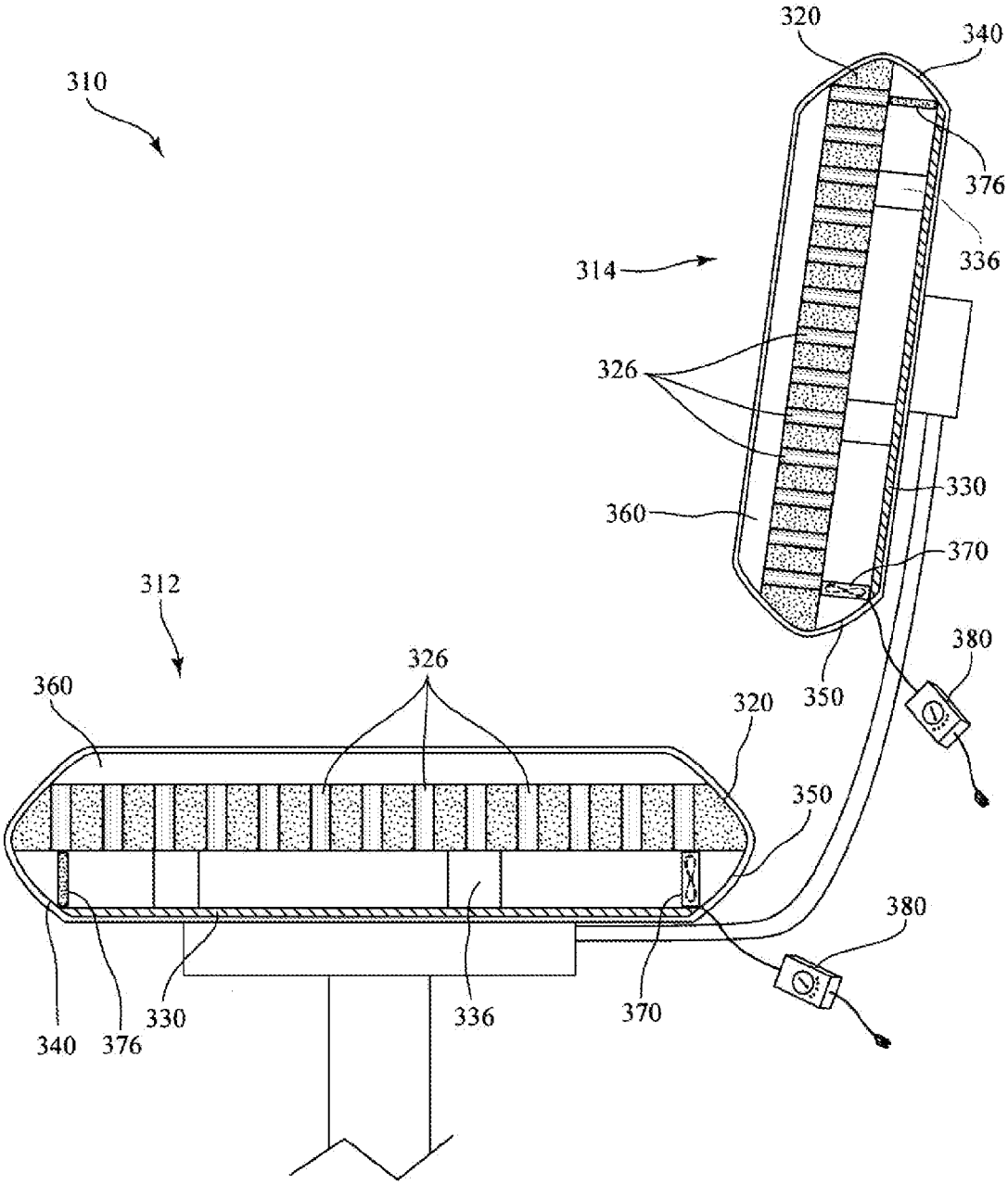
FIG. 9 is a cross-sectional view of exemplary support cushions for use in a chair and made in accordance with the present invention.

As yet another refinement to the present invention, although the support cushions shown in FIGS. 1-8 are in the form of mattresses 10, 110, 210, and are dimensionally sized to support a user lying in a supine or prone position, it is contemplated that the features described herein are equally applicable to head pillows, seat cushions, seat backs, neck pillows, leg spacer pillows, mattress topers, overlays, and the like. As such, the phrase "body support" or "body supporting" is used herein to refer to any and all such objects having any size or shape, and that are capable of or are generally used to support the body of a user or a portion thereof. For example, as shown in FIG. 9 support cushions made in accordance with the present invention are incorporated into the seat 312 and the back 314 of a desk chair 310. Each support cushion of the desk chair 310 includes a comfort layer 360, a body supporting portion 320 comprised of a reticulated visco-elastic foam and defining a plurality of columnar voids 326, and a base portion 330 defining a channel 336. The support cushions of the desk chair 310 also include a fan 370 and filter 376 operably connected, respectively, to an inlet 340 and an outlet 350 that are each in fluid communication with the channel 336. A controller 380 is further included in both the seat 312 and the back 314 and provides power to the fan 370, such that, in operation, the fan 370 moves air through and dissipates heat away from the support cushions.

Each of the exemplary support cushions described herein can also be used as part of a method of dissipating heat away from a support cushion. In some implementations, a method of dissipating heat away from a support cushion includes first providing a support cushion having: a body supporting portion; a base portion that is positioned adjacent to the body supporting portion and that defines a channel extending through the base portion, with the channel being in fluid communication with the body supporting portion; and a fan that is operably connected to the channel. Power, in the form of electrical current, is then supplied to the fan, such that the fan moves an amount of air through the channel and then dissipates heat away from the body supporting portion to thereby increase the comfort of a user resting on the mattress. In some implementations that make use of temperature and pressure sensors in an exemplary support cushion, as described in detail above, the surface temperature of the support cushion can controlled by first receiving feedback from a temperature or pressure sensor positioned in the body supporting portion of the support cushions, and then supplying power to the fans based on the feedback received from the temperature sensor, the pressure sensor, or both.

One of ordinary skill in the art will recognize that additional embodiments are also possible without departing from the teachings of the present invention or the scope of the claims which follow. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and may be made without departing from the spirit or scope of the claimed invention.

What is claimed is:

1. A support cushion, comprising:

a body supporting layer comprised of a first flexible foam and having a first surface and a second surface opposite the first surface, the body supporting layer further including a plurality of columnar voids defined by the body supporting layer and extending from the first surface of the body supporting layer to the second surface of the body supporting layer;

a comfort layer comprised of a second flexible foam and positioned atop the first surface of the body supporting layer;

a base layer positioned adjacent to the second surface of the body supporting layer, the base layer having a first exterior side surface and a second exterior side surface, and the base layer defining a channel extending through the base layer, the channel in fluid communication with the body supporting layer and having an inlet on the first exterior side surface and an outlet on the second exterior side surface; and a fan operably connected to the channel of the base layer, the fan for dissipating heat away from the body supporting layer and into the channel of the base layer.

2. The support cushion of claim 1, wherein the first exterior side surface is a head end of the base layer and the second exterior side surface is a foot end of the base layer, and wherein the fan is operably connected to the outlet.

3. The support cushion of claim 1, where the fan comprises a first fan connected to the inlet and a second fan connected to the outlet.

4. The support cushion of claim 1, wherein the base layer includes one or more walls positioned in the channel, the one or more walls for directing air flow through the channel.

5. The support cushion of claim 1, wherein the base layer, is comprised of a flexible foam.

6. The support cushion of claim 1, wherein the body supporting layer is comprised of a visco-elastic foam.

7. The support cushion of claim 6, wherein the body supporting layer is comprised of a reticulated visco-elastic foam.

8. The support cushion of claim 1, wherein the comfort layer is comprised of a visco-elastic foam.

9. The support cushion of claim 8, wherein the visco-elastic foam comprising the comfort layer has a density less than that of the visco-elastic foam comprising the body supporting layer.

10. The support cushion of claim 1, wherein each of the columnar voids are in fluid communication with the channel.

11. The support cushion of claim 1, further comprising a filter operably connected to the inlet, the outlet, or both the inlet and the outlet.

12. The support cushion of claim 1, further comprising a controller for controlling an amount of power supplied to the fan.

13. The support cushion of claim 12, wherein the controller is configured to allow power to be supplied to the fan for a predetermined time period.

14. The support cushion of claim 12, further comprising one or more temperature sensors for providing thermal feedback to the controller, the one or more temperature sensors operably connected to the body supporting layer.

15. The support cushion of claim 12, further comprising one or more pressure sensors for providing pressure feedback to the controller, the one or more pressure sensors operably connected to the body supporting layer.

16. The support cushion of claim 1, wherein the body supporting layer is dimensionally-sized to support a user lying in a supine or prone position.

17. A mattress, comprising:

a body supporting layer comprised of a first flexible foam, the body supporting layer having a first surface and a second surface opposite the first surface the body supporting layer further including a plurality of columnar voids defined by the body supporting layer and extending from the first surface of the body supporting layer to the second surface of the body supporting layer;

a comfort layer comprised of a second flexible foam and positioned atop the first surface of the body supporting layer;

a base layer positioned adjacent to the second surface of the body supporting layer, the base layer defining a first channel and a second channel extending longitudinally through the base layer, the first channel and the second channel each having an inlet on a first exterior side surface of the base layer and an outlet on a second exterior side surface of the base layer, the first channel and second channel positioned on opposite sides of the base layer, and the first channel and the second channel each in fluid communication with the body supporting layer;

a first fan operably connected to the first channel, the first fan for dissipating heat away from the body supporting layer and into the first channel of the base layer; and a second fan operably connected to the second channel, the second fan for dissipating heat away from the body supporting layer and into the second channel of the base layer.

18. The mattress of claim 17, wherein the first flexible foam is a reticulated visco-elastic foam.

19. A method of dissipating heat away from a support cushion, comprising:

providing a support cushion including:

a body supporting layer comprised of a first flexible foam, the body supporting layer having a first surface and a second surface opposite the first surface, the body supporting portion further including a plurality of columnar voids defined by the body supporting layer and extending from the first surface of the body supporting layer to the second surface of the body supporting layer;

a comfort layer comprised of a second flexible foam and positioned atop the first surface of the body supporting layer;

a base layer positioned adjacent to the body supporting layer, the base layer having a first exterior side surface and a second exterior side surface, and the base layer defining a channel extending through the base layer, the channel in fluid communication with the body supporting layer and having an inlet on the first exterior side surface and an outlet on the second exterior side surface, and a fan operably connected to the channel of the base layer; and supplying power to the fan, such that the fan moves an amount of air through the channel and dissipates heat away from the body supporting layer and into the channel of the base layer.

* * * * *